US005131301A

United States Patent [19]

Gergek

[11] Patent Number: 5,131,301

[45] Date of Patent: Jul. 21, 1992

[54] PAPER CUTTING MACHINE

[76] Inventor: Franc Gergek, 1234 Reid Street, Richmond Hill, Ontario, Canada, L4B 1C1

[21] Appl. No.: 505,474

[22] Filed: Apr. 6, 1990

[30] Foreign Application Priority Data

Apr. 7, 1989 [CA] Canada ..... 596066

[51] Int. Cl.[5] ..... B26D 7/01

[52] U.S. Cl. ..... 83/13; 83/365; 83/367; 83/468.7; 83/520; 83/521

[58] Field of Search ..... 83/13, 76.8, 76.6, 76.7, 83/365, 367, 371, 467.1, 468, 468.7, 520, 521, 522.17, 522.18, 522.19; 250/548, 557; 33/1 M

[56] References Cited

U.S. PATENT DOCUMENTS

| | | | |
|---|---|---|---|
| 1,952,073 | 3/1934 | Jones | 83/521 X |
| 3,470,778 | 10/1969 | Mohr | 83/365 |
| 3,656,391 | 4/1972 | Von Arx | 83/521 |
| 3,763,730 | 10/1973 | Ahlegian | 83/521 |
| 4,025,025 | 5/1977 | Bartel et al. | 250/548 X |
| 4,331,050 | 5/1982 | Gergek | 83/468 X |
| 4,380,946 | 4/1983 | Mayston | 83/521 |
| 4,503,740 | 3/1985 | Brand et al. | 83/521 |
| 4,641,828 | 2/1987 | Yajima | 83/367 X |
| 4,932,131 | 6/1990 | McMurtry et al. | 33/1 M |

FOREIGN PATENT DOCUMENTS

| | | | |
|---|---|---|---|
| 558120 | 2/1957 | Italy | 83/365 |

*Primary Examiner*—Frank T. Yost
*Assistant Examiner*—Eugenia A. Jones
*Attorney, Agent, or Firm*—Samuel Meerkreebs

[57] ABSTRACT

A sensing mechanism for use with a paper cutting machine having a table for supporting a pile of sheets to be cut. There is provided a knife for cutting the pile, a movable clamp for the pile, a back gauge for movement along the table against the pile to position it for cutting. A camera is provided for positioning over the table to observe a target area of the surface of the top sheet on the pile, containing marking indicating a desired cutting line. A visual display device is located remote from the camera and operatively connected thereto to display a visual image of the target area. The display is provided with reference marking for registry with said cutting marking on the top sheet when the pile is in a position a known distance from the cutting position.

12 Claims, 5 Drawing Sheets

FIG. 5
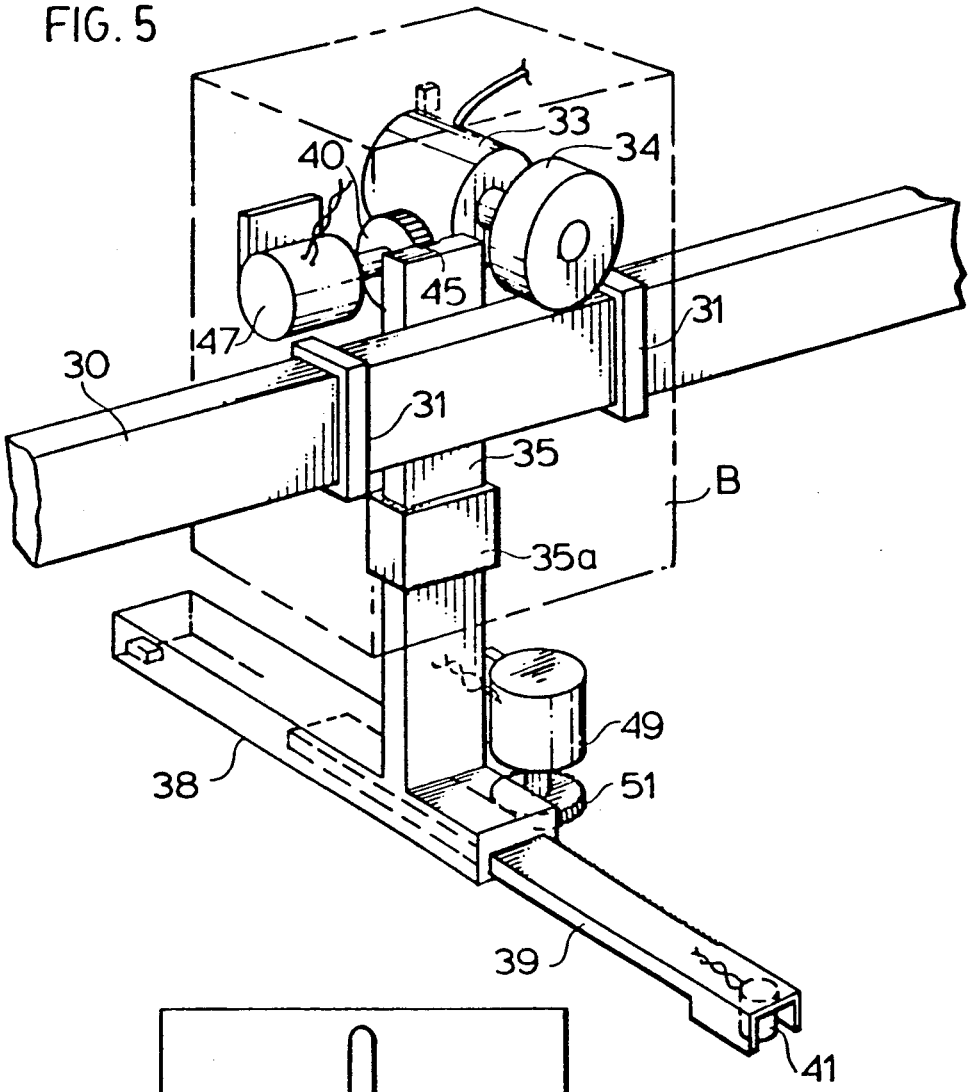
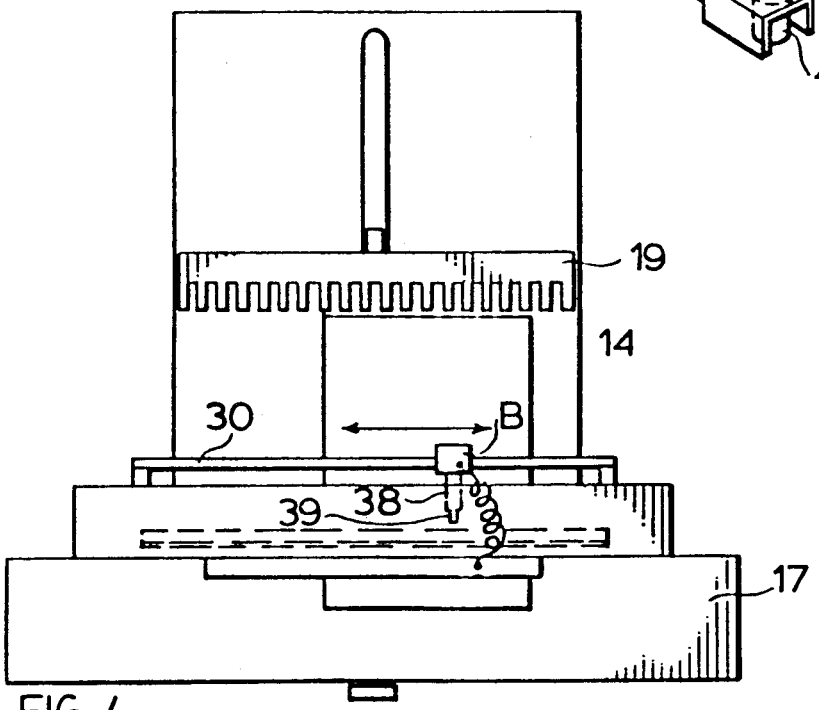
FIG. 4

PAPER CUTTING MACHINE

BACKGROUND OF THE INVENTION

1. Field of the Invention

This invention relates to a paper cutting machine.

Such a machine, and its operation in general, is described in U.S. Pat. No. 4,331,050, Gergek, May 25, 1982. The disclosure of that patent is hereby incorporated by reference.

The apparatus shown in that patent is equipped for sensing the position of an initial cut through a pile of paper on the machine and for moving the back gauge to repeat the cut in precisely the same position on another pile.

The present invention is directed to positioning the pile to be cut so that the cut will be made precisely along a predetermined cutting line.

This aim is to overcome inaccuracies in locating the cutting line encountered with previous apparatus.

2. Description of the Prior Art

In accordance with the prior art, one way of locating the cutting line has been to provide the machine with a light which shines a beam on to the surface of the top sheet of paper. A problem here is that the paper is some distance away from the light source so that the intensity of the light on the paper is too low for good observation and the beam too wide for accuracy. Moreover, the beam on the paper must be observed by the operator looking at it diagonally from his position in front of the machine and this further limits accuracy.

An alternative way of setting the paper is to lower the clamp and to observe where its edge is relative to indicia on the paper. A problem here is that, while the clamp is down against the paper, the pile cannot be moved to adjust the position with respect to the desired cutting line and the clamp has to be raised and lowered again. Further, the operator can only see the paper in front of the clamp which obscures the paper behind it. So, if the cutting guidemark is obscured by the clamp, the latter must be raised so that the paper can be moved in another attempt to locate the pile into cutting position. Besides not being precise, this process is time-consuming.

SUMMARY OF THE INVENTION

The present invention aims to overcome the above-mentioned shortcomings and to provide ways and means for accurately placing the pile of paper to be cut in the precise cutting position.

The invention then, is a sensing mechanism, for use with a paper cutting machine having a table for supporting a pile of sheets to be cut, a knife for cutting said pile, a clamp for retaining the pile for cutting, means for operating the knife and means for moving the clamp up and down, a back guage for movement along the table against the pile to position it for cutting, and means for moving the back gauge forward and backwards.

More specifically, the sensing mechanism includes optical sensing means such as a camera for positioning over the table in a position to observe a target area of the surface of the top sheet containing marking denoting the desired cutting line.

A visual display, such as a monitor remote from the camera and operatively connected thereto is adapted to display an image of the target area observed by the camera. The display monitor is provided with a reference line for alignment with cutting marking on the top sheet, designating the desired cutting line. The operator can, therefore, adjust the position of the pile so that the cutting marking registers with the reference line on the display.

In one embodiment of the invention, the camera is manoeuverable sideways, up and down, forward and backwards relative to the table so that the camera can be maneuvered to sense a target area, including the actual cutting position beneath the knife.

In another embodiment of the invention, the camera is only maneuverable upwards and downwards of the table, but not backwards and forwards, so the pile has to be manoeuvered also to bring the target area of the paper containing the cutting marking within range of the camera. In this case, the distance between the cutting line marking and the actual cutting position is a known quantity and the machine is programmed so that once the cutting marking registers with the reference line on the display the machine is operated by computer to move the cutting line marking into actual cutting position.

In still another embodiment, the sensing means is movable up and down, for example, by its mounting on the paper press. The operation of this form is similar to that just described. The cutting marking must be located on the top sheet so as to extend far enough in the lateral direction to fall underneath the camera.

The invention also contemplates providing the camera with means for illuminating the target area to make the cutting marking more legible.

The invention also contemplates the use as camera of a reflector mounted in a position for reflecting the target area. In this case, there are means remote from the reflector for converting the visual image reflected into video signals. An optical cable is arranged to transmit the image from the reflector to the converting means. Appropriate conducting means conveys the video signals from the converting means to the display monitor.

BRIEF DESCRIPTION OF THE DRAWINGS

The invention will now be described more specifically by reference to the accompanying drawings, which illustrate preferred embodiments, and in which:

FIG. 4 is a top plan view of the machine shown in the previous Figs., FIG. 5 is a further enlarged front perspective view showing the sensing apparatus of the previous Figs. in more detail.

Figure 1:
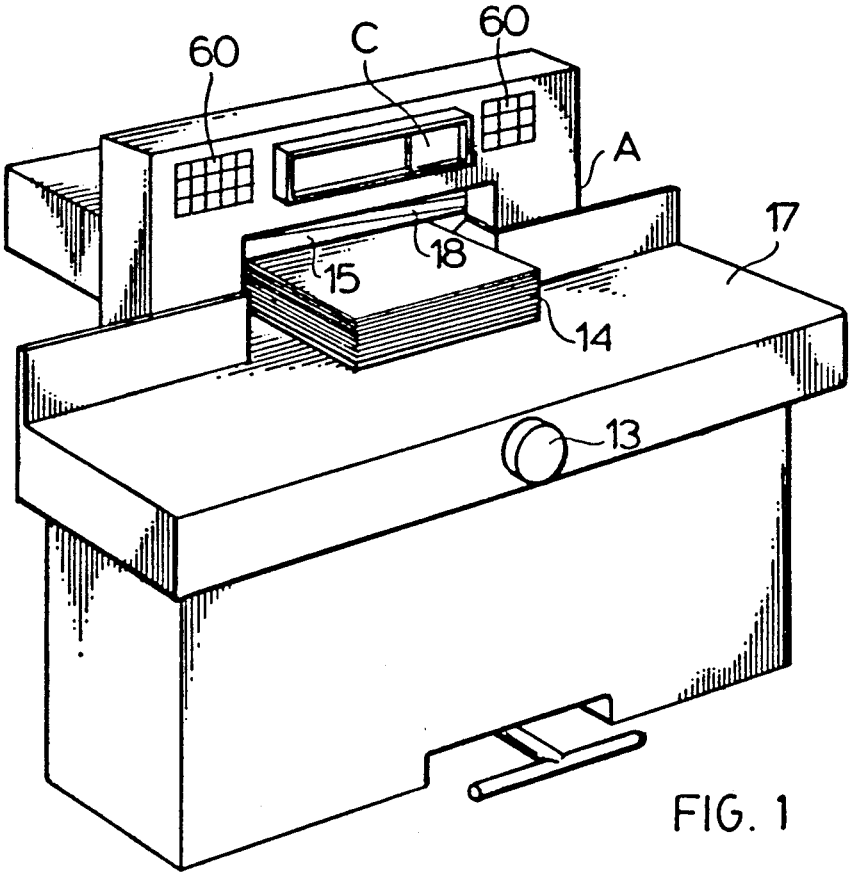
FIG. 1 is a front perspective view of a paper cutting machine to which a sensing apparatus according to the invention is attached, carrying a pile of paper to be cut.

Referring more particularly to the drawings, particulary FIGS. 1 to 5, the nature of the cutting apparatus shown will be explained.

The printed stock from sheet-fed presses comes in the form of a pile of sheets 14 which is deposited on a table 17. The pile is usually a few inches deep and a back gauge 19 is movable above the table by suitable mechanism including a worm gear which is manipulated by a handle, or automatically.

Above the table 17 there is a main frame A in which is operatively mounted, for up and down movement, a paper clamp 15 and a knife blade 18.

The top sheet is marked to show the cuts required to sever the sheets into pages, coupons, etc. This mechanism is well understood and is described in U.S. Pat. No. 4,331,050, Gergek (1982).

In operation, the back gauge 19 is manipulated by the knob 13, or automatically, so that the back gauge acts against the paper pile 14 to push it forward on the table 17 into cutting position beneath the blade 18. Operating push buttons are shown at 60.

Figure 2:
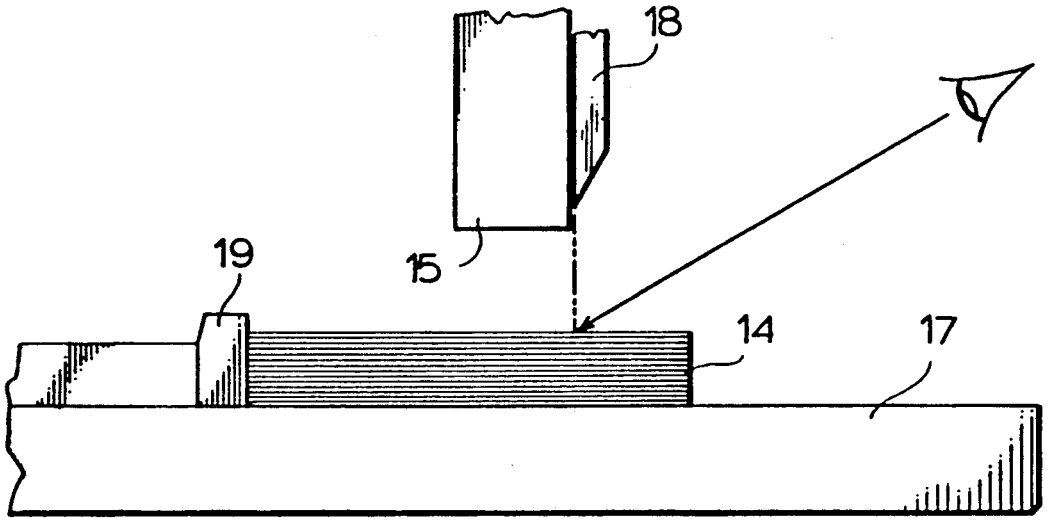
FIG. 2 is a diagrammatic view, illustrating a prior art way of observing the desired cutting line.
Figure 3:
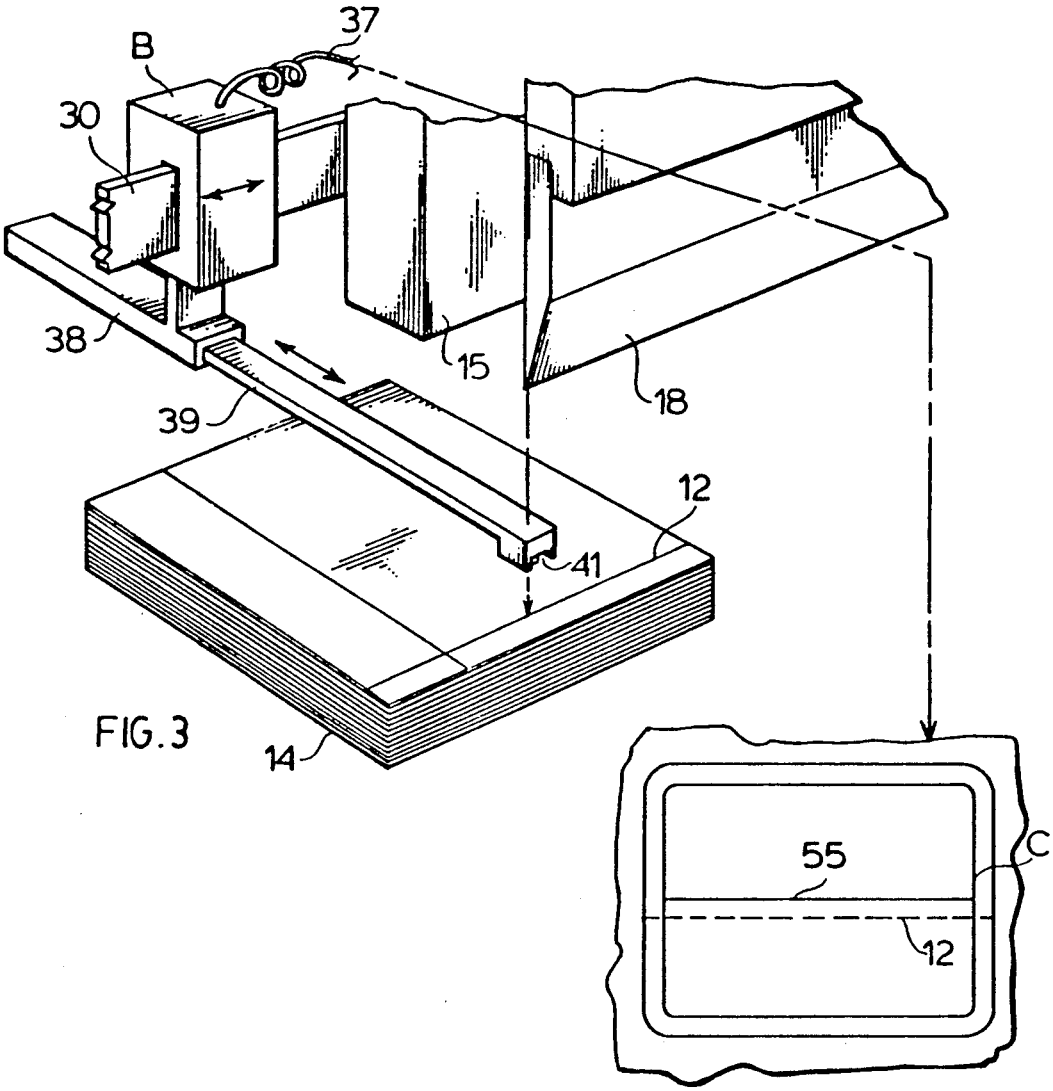
FIG. 3 is an enlarged schematic view illustrating particularly the sensing apparatus and showing the display operatively connected to it.

Normally, the operator manipulates the pile 14 through the back gauge 19 till the marking showing the cutting line is brought directly under the knife. The operator usually observes this visually as shown in FIG. 2. As mentioned previously, this way of placing the cutting line has shortcomings which the present invention aims to overcome.

To this end, the apparatus is equipped with sensing mechanism as will now be described.

A sensing apparatus is mounted from the frame A. This apparatus includes a rail 30 connected to the frame behind the knife 18 and paper clamp 15. A carriage B is movable laterally back and forth on the rail 30 by a motor 33 driving a friction wheel 34 which engages the surface of the rail 30. Slidable vertically relative to the carriage B is a lift rod 35 which engages a bracket 35*a* connected to the carriage B. The lift rod is thus movable up and down relative to the table 17.

The rod 35 carries, on its lower end, a hollow supporting beam 38. An arm 39 is carried by the beam 38 for movement relative to it in the fore and aft direction.

The forward end of the arm 39 carries a camera 41. The camera 41 is electrically connected to an insulated conductor wire (not shown) which extends rearwards along the beam 38, upwards through the rod 35 and thence to a conductor 37 which leads to a display monitor C. The camera 41 is thus electrically connected to the display monitor C.

The rod 35 has on its rear face a rack 45 engaged by a pinion 40 driven from a motor 47 mounted on the carriage B, for moving the rod 35 up and down.

A motor 49 moves the arm 39 forward or backward by driving a pinion 51 which engages in a rack (not shown) in the side of the arm 39.

Operation of Sensing Apparatus

The operation of the sensing apparatus is as follows. The camera 41 is placed over the top sheet of the pile 14 and close to it in the desired lateral position. This is done by the operator manipulating the carriage B, the rod 35 and the arm 38. The camera 41 is thus brought directly over a target area of the top sheet on the pile 14.

The pile 14 is then moved by manipulating the back gauge 19 until a cutting marking within the target area may be observed by the camera 41 and adjustments made until the cutting marking 12 on the top sheet registers with a reference line 55, on the display C.

Figure 6:
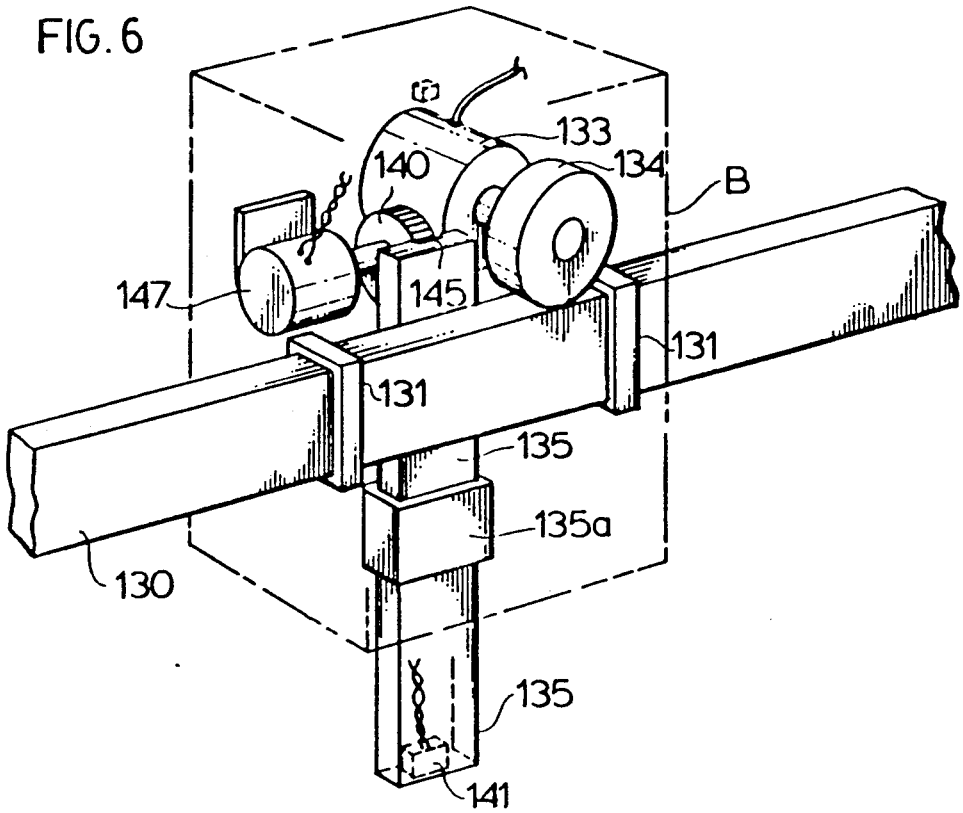
FIG. 6 is a view on the scale of FIG. 5 showing an alternative sensing apparatus.
Figure 7:
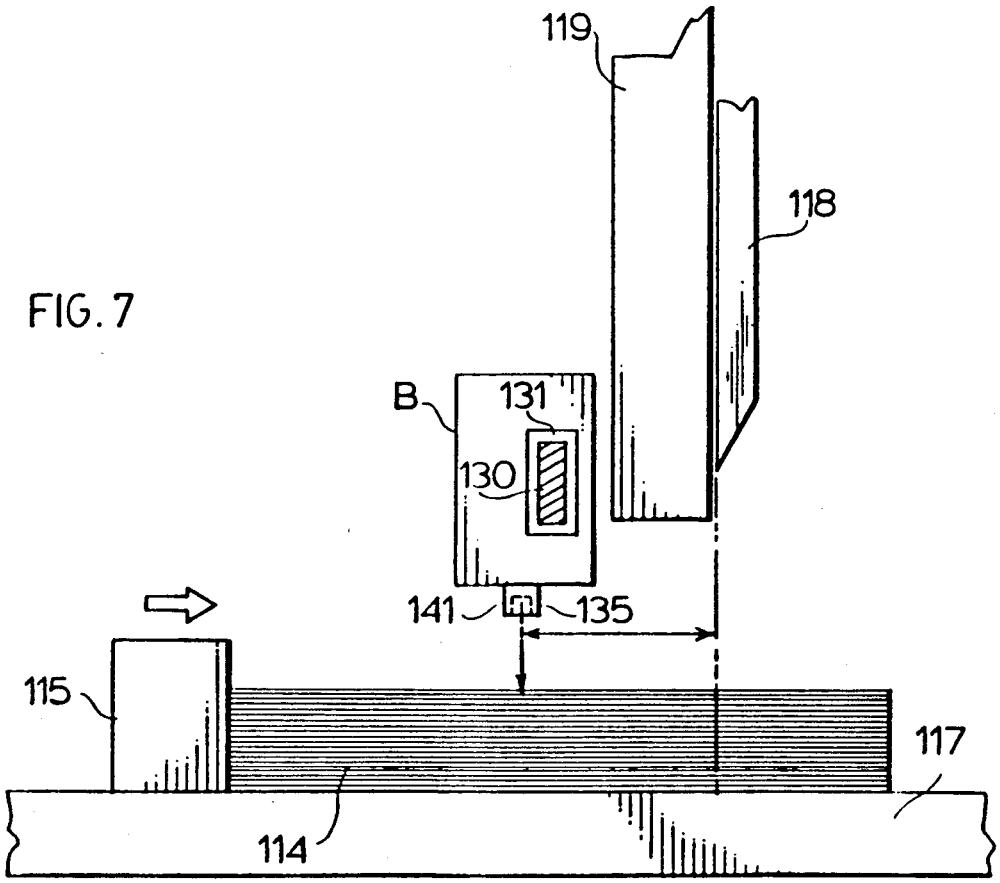
FIG. 7 is a side elevation, partly in section, of the apparatus shown in FIG. 6, but on a smaller scale, FIG. 8 (on the sheet with FIG. 3) is a greatly enlarged fragmentary view showing a sensing apparatus mounted on the paper clamp.

Embodiment of FIGS. 6 and 7

A modification of the sensing apparatus is shown in FIGS. 6 and 7. Corresponding parts to those of the previous Figs. have been given reference numbers with the same tens and digits but have been raised by 100. The letters have likewise been raised by 1, e.g. $B_1$.

In this embodiment, the camera 141 is mounted at the foot of the rod 135.

In the operation of this device, the cutting marking is observed as shown in FIG. 7. The cutting marking is a known distance from the actual cutting position. So, once the cutting marking has been brought into register with the reference line on the display, the operator advances the pile 114 through the known distance so that the cutting marking is brought into cutting position beneath the knife. This is normally done by pressing a button to actuate appropriately programmed computer mechanism.

Figure 8:
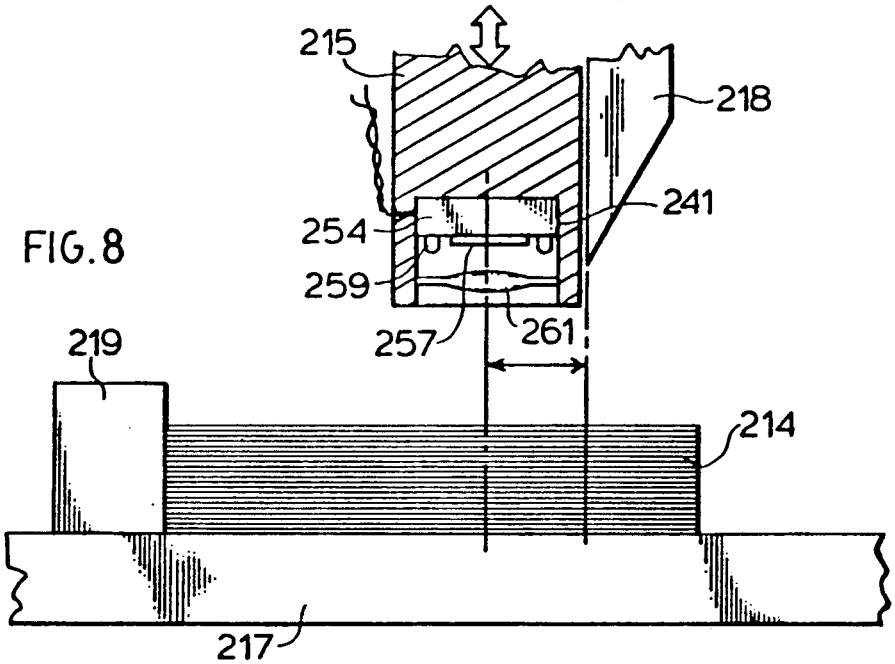

Embodiment of FIG. 8.

FIG. 8 illustrates a still further embodiment of the invention. Similar numbers to the previous Figs. identify similar parts with the exception that they have been raised to the 200 series. The letters have been given the subscript "2".

In this case, the camera 241 is mounted underneath the paper clamp 215.

The camera is made up of a base 254 which carries an image sensing element 257 and electric light bulbs 259. Spaced from the sensing element proper is a lens 261.

As in the case of the embodiment shown in FIGS. 6 and 7, the cutting marking is brought into register with the camera at a predetermined distance from the actual cutting line, so that it registers with the reference line of the display C. Then, the pile 214 is moved by the operator so that the cutting marking actually falls in cutting position beneath the knife 218.

Figure 9:
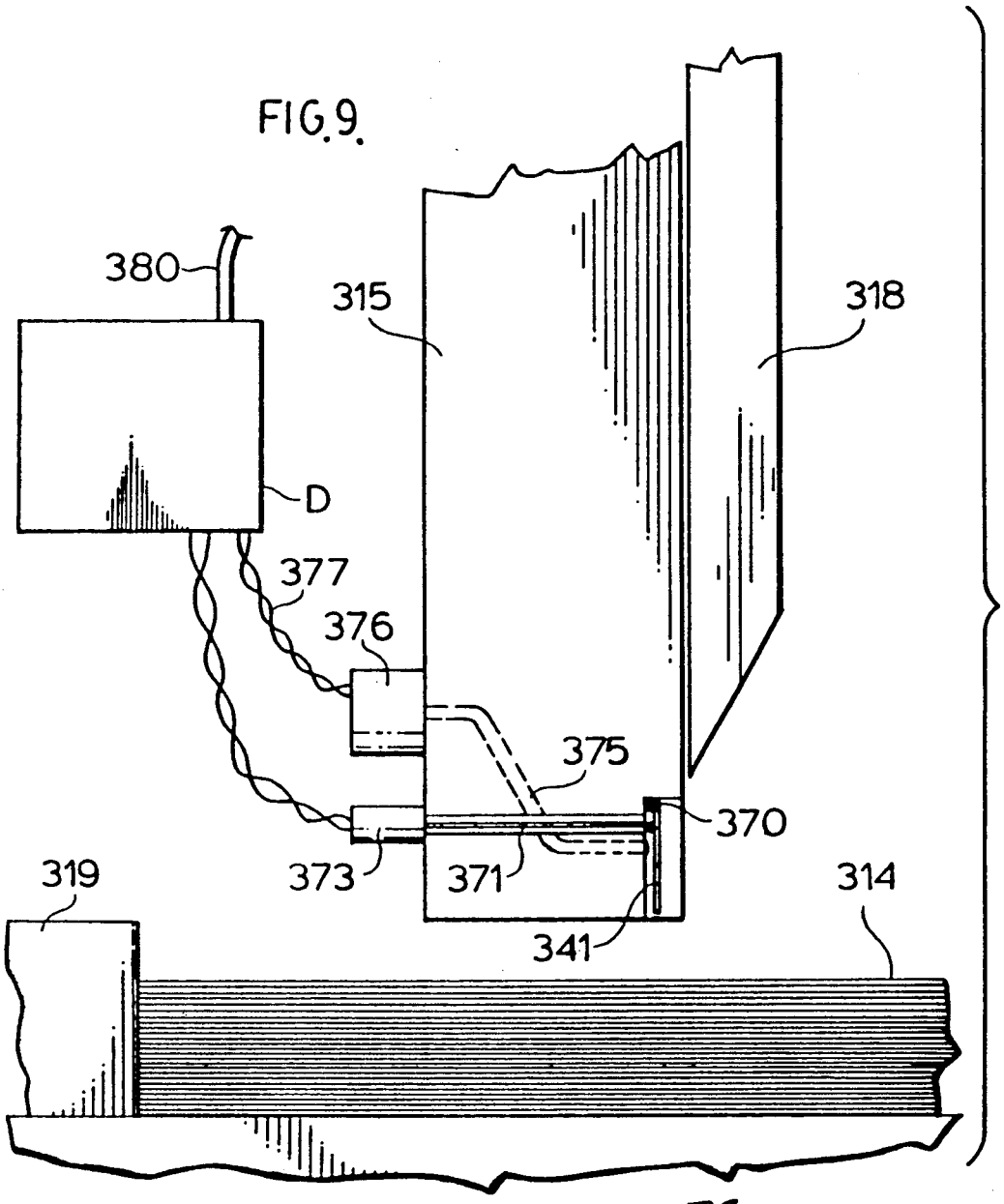
FIG. 9 is a greatly enlarged fragmentary side elevation illustrating a still further embodiment of the invention using a reflector, with the latter shown in the stowed position.
Figure 10:
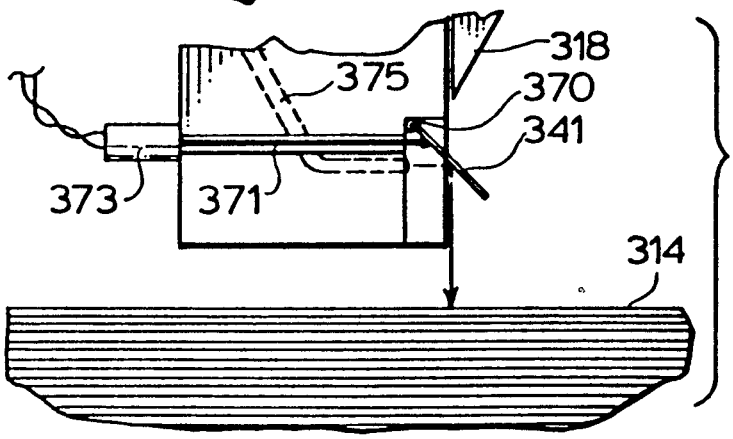
FIG. 10 is a side elevation similar to FIG. 9 showing the reflector in operative position.

Embodiment of FIGS. 9 and 10.

A still further embodiment of the invention is shown in FIGS. 9 and 10. The reference numerals have been raised to the 300 series.

A paper clamp 315 is shown in side elevation behind the knife 318. A reflective sensing element 341, e.g. a mirror, is hingedly connected to the clamp 315 as at 370 for nesting in an indentation in the front bottom corner of the clamp or for swinging from a stowed position against the clamp 315 (FIG. 9) out to an angle as shown in FIG. 10. An operating rod 371 is hingedly connected to the reflector 341 and extends through a channel in the clamp 315 to a solenoid 373 operable to move the reflector 341 between nesting and operative positions. An optical cable 375 extends through an opening in the clamp from a forward position within optical access to the reflector 341 to a converter 376 which converts the optical signals conveyed by the cable 375 to video signals. A conductor 377 connects the converter with the display monitor C.

In this way, a target area of the top sheet of the pile 314 may be observed by the reflector 341 while manipulating the pile 314 into position. The image is conveyed optically through the cable 375 to the converter 376 and thence as video signals to the display monitor C. The pile 314 is manipulated as described in connection with the embodiments of FIGS. 6 to 8 to bring the cutting line beneath the reflector 341 and thence into position so that the cutting marking is in register with the reference line on the display monitor C. The pile is then manipulated automatically so that the cutting marking is brought into actual cutting position beneath the knife 318.

To avoid unnecessarily complicating the disclosure, the cutting machine and the sensing mechanism have been shown diagrammatically without illustrating structural details which will be apparent to one skilled in the art.

Similar remarks apply to electrical, electronic and computer features which will also be readily apparent to those skilled in these fields.

By way of example, the camera may be a CCD camera. The display monitor may be of the graphic display type LCD unit.

I claim:

1. A method of sensing a target area in a paper cutting machine wherein the paper cutting machine has a table for supporting a pile of sheets of paper to be cut while in a stack, a knife for cutting said pile of sheets, a clamp for said pile, the method comprising the steps of:

(a) providing a mark on the pile of sheets representative of a reference for a cutting line, (b) optically recording an image of the target area on the top sheet of a pile of sheets on said table in which said top sheet has the mark, (c) visually displaying, remotely from said target area, a visual image of said target area with respect to a reference when said pile is in a known position, and (d) cutting the pile of paper when the mark of the pile of paper and the reference are in alignment.

2. A sensing mechanism for use with a paper cutting machine having a table for supporting a pile of sheets to be cut, a knife for cutting said pile of sheets, a clamp for the pile, means for operating the knife in a cutting area and means for moving the clamp up and down adjacent the cutting area relative to the pile of sheets, a back gauge for movement along the table against the pile of sheets to position it for cutting, and means for moving the back gauge forward and backward relative to the cutting area, characterized in that there are:

camera means positioned over the table to record and transmit an image of a target area of the surface of the top sheet on the pile containing a marking indicating a desired cutting line, visual display means located remote from the cutting area, and transmission means connecting the camera means to the visual display means thereto to display a visual image of said target area thereon, said visual display means being provided with a reference marking for registry with the visual image of marking on the top sheet in the target area when the pile is in a position from the cutting position in the cutting area.

3. A mechanism as defined in claim 2, in which the camera means is movable sideways, up and down, and forwards and backwards relative to the table so that the camera means can be maneuvered to record the target area with the marking and the cutting area.

4. A sensing mechanism, as defined in claim 3, in which there is, carriage means movable laterally of the machine, means movable vertically relative to said carriage means, means movable horizontally of said vertically movable means in the forward direction, the camera means being mounted on said horizontally movable means, motor means for moving the carriage means, the vertically movable means and the horizontally movable means, and means for controlling said motor means whereby the camera means may be moved laterally, up and down, and forward and backward relative to the table.

5. A mechanism, as defined in claim 4, in which the sensing mechanism includes a rail extending laterally of the machine behind the knife, said carriage means movable back and forth on said rail, said means movable vertically including lifting means movable up and down relative to said carriage means, said means movable horizontally including support means on said lifting means and extending forwardly therefrom, transport means for fore and aft movement relative to said support means, said motor means moving the carriage means, the lifting means and the support means, and the camera means being mounted on a forward part of the support means.

6. A mechanism, as defined in claim 4, in which there is a separate motor for moving each of the carriage means, the lifting means, and the support means.

7. A mechanism, as defined in claim 2, in which the camera means is movable upwards and downwards of the table whereby the camera means can be maneuvered to record a target area of the pile of sheets containing the marking at a known distance from the actual cutting position, and there is means programmed to advance the pile of sheets through said known distance to bring it into cutting position.

8. A mechanism, as defined in claim 7, in which there is carriage means movable laterally of the machine, lifting means movable up and down relative to said carriage means, the camera means being mounted on a lower part of the lifting means, motor means for moving the carriage means and lifting means, and means for controlling the motor means.

9. A mechanism, as defined in claim 7, in which the camera means is mounted on a lower part of the paper clamp.

10. A mechanism, as defined in claim 9, in which the camera means is mounted in a recess in said paper clamp, and is provided with lighting means to illuminate the target area.

11. A mechanism, as defined in claim 10, in which the camera means is provided with a lens between it and the table.

12. A mechanism, as defined in claim 2, in which the camera means includes reflecting means for reflecting the target area and the cutting area, the camera means including converting means having reflecting means for converting a visual image into video signals, optical cable means for transmitting the image from the reflecting means to the converting means, said transmission means conveying the video signals from the camera means to the visual display means.

* * * * *